United States Patent [19]

Goi et al.

[11] Patent Number: 4,726,862

[45] Date of Patent: Feb. 23, 1988

[54] PROCESS FOR PRODUCING TUBULAR SHAPED FIBROUS ARTICLES

[75] Inventors: Shigeru Goi, Moriyama; Taizo Sugihara, Omihachiman; Hiroshi Sonoda, Shiga, all of Japan

[73] Assignee: Chisso Corporation, Osaka, Japan

[21] Appl. No.: 33,827

[22] Filed: Apr. 3, 1987

[30] Foreign Application Priority Data

Apr. 23, 1986 [JP] Japan ..... 61-93858

[51] Int. Cl.[4] ..... B29D 23/00

[52] U.S. Cl. ..... 156/180; 156/285; 156/441

[58] Field of Search ..... 156/180, 441, 308.2, 156/309.6, 285; 493/42–45, 49, 50; 19/65 T, 66 T; 131/340, 343, 344; 425/503, 505, 403, 812

[56] References Cited

U.S. PATENT DOCUMENTS

| | | | |
|---|---|---|---|
| 3,095,343 | 6/1963 | Berger | 156/441 X |
| 3,852,009 | 12/1974 | Roberts et al. | 19/65 T X |
| 4,179,323 | 12/1979 | Sigmon | 493/45 X |
| 4,270,962 | 6/1981 | Sugihara et al. | 156/180 |

*Primary Examiner*—Donald E. Czaja

*Attorney, Agent, or Firm*—Oblon, Fisher, Spivak, McClelland & Maier

[57] ABSTRACT

In a process for producing tubular shaped fibrous articles of small diameter by heating and cooling a fibrous bundle containing at least 20 weight % of hot-melt-adhesive composite fibers, the improvements comprise using a shaping apparatus including an injecting chamber, an injecting hole formed in the wall of the chamber, a fibrous bundle outlet provided with a nozzle of a desired shape in cross-section, a cylindrical pipe for introducing the fibrous bundle, which has a cross-sectional area larger than that of the outlet, is located at a position opposite to the outlet and projects toward the outlet and terminates in the injecting chamber, and a core pipe which is open at its base on the outside of the injecting chamber, has its one end inserted through the cylindrical pipe and extending into the nozzle through the injecting chamber, and having a vent in its portion exposed within the injecting chamber, and passing the fibrous bundle through the cylindrical pipe to the outlet, while injecting a hot compressed gas through the injecting hole, thereby to heat and shape the fibrous bundle to and at its hot-melt-adhesive temperature.

5 Claims, 4 Drawing Figures

PROCESS FOR PRODUCING TUBULAR SHAPED FIBROUS ARTICLES

BACKGROUND OF THE INVENTION

1. FIELD OF THE INVENTION

The present invention relates to a process for producing tubular shaped fibrous articles.

2. STATEMENT OF THE PRIOR ART

Rod shaped fibrous articles used as a core for belt-tip pens*, filters, etc. have heretofore been prepared by cutting fulled felts of wool or felts of chemical fibers or synthetic fibers obtained by employing a binder or through mechanical entanglement, to predetermined shaped and sizes. (* felt-tip pens: the core, the end portion of which is felt-tip, is made from compact fibrous materials). Further, in the case of tobacco filters and the like, use has been made of a process comprising the steps of depositing triacetin onto crimped tows to plasticize it and shaping the resulting products into rods. Still further, in recent years, various shaped fibrous articles have been obtained with the use of hot-melt-adhesive composite fibers. For instance, U.S. Pat. No. 4,270,962 disclosed a process for producing rod-form shaped fibrous articles by heat treating a fibrous bundle containing at least 20% by weight of adhesive fibers by introducing the fibrous bundle into a heating zone through an elongated transport zone consisting of a single hollow pipe that is surrounded by said heating zone, imparting heat to the exterior portion of said fibrous bundle by directing heat against the exterior of said transport zone and imparting heat throughout the interior of said fibrous bundle by directing heated gas outwardly through the interior of said transport zone in a direction opposite to the inward movement of said fibrous bundle through said transport zone. With this process, however, it is possible to obtain solid rod-form shaped fibrous articles, but it is impossible to obtain hollow ones.

U.S. Pat. Nos. 4,100,009 and 4,197,156 specifications teach a method for producing a hollow-cylindrically shaped fibrous article stabilized by hot adhesion, which comprises passing a web of gathered fiber layer carried on a conveyor belt through a heating zone, heating said web in such a way that a lower-melting component of composite fiber contained in the lower part of said web contacting the conveyor belt is not in the molten state and a lower-melting component contained in the upper part of said web is in the molten state, while separating said web from the conveyor belt, winding up said web on a take-up rod or tube in such a way that the upper surface thereof occupies the inner side of the winding, while heating the web further, cooling the wound up article and drawing out the take-up rod or tube from the shaped product, and an apparatus for carrying out the same. However, this method provides only shaped articles which are hard as well as of larger diameter and thickness, and involves relatively complicated steps.

SUMMARY OF THE INVENTION

As a result of intensive and extensive studies made of a process for producing tubular shaped fibrous articles of small diameter, the desired object has been achieved by the provision of a process for producing tubular shaped fibrous articles by heating and cooling a fibrous bundle containing at least 20 weight % of hot-melt-adhesive composite fibers, wherein the improvements comprise:

using a shaping apparatus including an injecting chamber, an injecting hole formed in the wall of said chamber, a fibrous bundle outlet provided with a nozzle of a desired shape in cross-section, a fibrous bundle-introducing cylindrical pipe, which has a cross-sectional area larger than that of said outlet and is located at a position opposite to said fibrous bundle outlet and projects toward said fibrous bundle outlet and terminates in said injecting chamber, and a core pipe which is open at its base on the outside of said injecting chamber and has its one end inserted through said fibrous bundle-introducing cylindrical pipe and extends into said nozzle through said injecting chamber and has vents in its portion exposed within said injecting chamber, and passing said fibrous bundle through between said fibrous bundle-introducing cylindrical pipe and said core pipe to said fibrous bundle outlet, while injecting a hot compressed gas through said injecting hole, thereby to heat to and to shape said fibrous bundle to and at its hot-melt-adhesive temperature. The present invention has been accomplished on the basis of such findings.

BRIEF DESCRIPTION OF THE DRAWINGS

The present invention will become apparent from the following detailed description with reference to the accompanying drawings, which are given for the purpose of illustration alone, and in which.

DETAILED DESCRIPTION OF THE PREFERRED EMBODIMENTS

Figure 1:
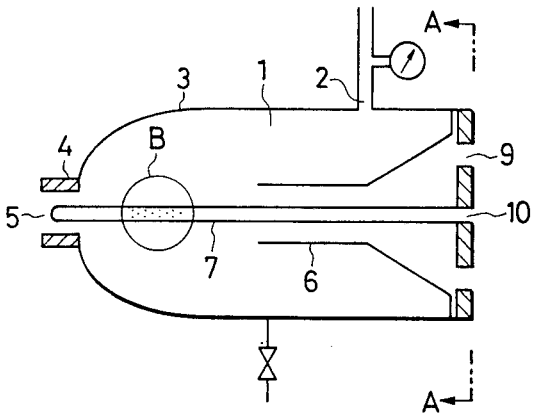
FIG. 1 is a schematical view showing one example of the shaping apparatus according to the present invention.

As the hot-melt-adhesive composite fibers to be used in the present invention, use may be made of any composite component fibers wherein there is a difference of 10° C. or higher in melting point between the composite components, and a low-melting component forms at least a part of the surface of each fiber and exhibits hot-melt adhesiveness. In an advantageous embodiment, however, preference is given to the composite fibers having a melting-point difference of 20° C. or higer and a side-by-side or sheath-core structure wherein the fiber circumferential proportion, in cross-section, of a low-melting component amounts to 50 to 100%. The combinations of composite components to be mentioned include (polyproplene/polyethylene), (polypropylene/ethylene-vinyl acetate copolymers or their saponified products or mixtures thereof with polyethylene), (polyester/polypropylene), (nylon 6/nylon 66), and the like. Heating is carried out at the hot-melt-adhesive temperature, a temperature between the melting points of both composite components, whereby the low-melting component melts and adheres together, while its fibrous form remains unchanged. The fineness of fibers used may optionally be selected from a wide range of 0.5 D/F (abbreviation of "denier per filament") to 200 D/F inclusive. The degree of crimping is preferably in a range of 3 to 30 crimps per inch. Crimp may be of either the mechanical or the steric type. The fibrous bundles used may be in the form of tows, filament yarns, slivers, spun yarns, etc. Other fibers to be mixed with the composite fibers may include natural fibers, bast fibers, chemical fibers, synthetic fibers, etc.

The hot compressed gases used usually include air or steam, but other gases such as nitrogen may be used. Steam is superior in the conduction of heat to air, and the use of steam makes the shaping apparatus more compact and the shaping speed higher. Where moisture is undesired, air is preferred. In order to conduct an amount of heat to the fibrous bundle as fast as possible, the heated gas is previously compressed to a higher pressure, then passed deeply through within the fibrous bundle, and is finally discharged under reduced pressure to the atmosphere. A main pressure of 1 to 5 $Kg/cm^2$ (gauge) is preferred to this end. The gas may be heated by either passing it through a heating device heated by a sheath heater element, or applying external heat to a pipe through which it is passed.

Further explanation will be made together with one preferable apparatus used in the process of the present invention.

Referring now to the drawings, reference numeral 1 stands for an injecting chamber, 2 an injecting hole, 3 a shaping apparatus, 4 a nozzle, 5 a fibrous bundle outlet, 6 a fibrous bundle-introducing cylindrical pipe, 7 a core pipe, 8 a vent, 9 a fibrous bundle-introducing inlet, 10 an opening in the base end of the core pipe, 11 a fibrous bundle, 12 a tubular shaped fibrous body, 13 a take-up means, 14 a cutter, and 15 a product.

The fibrous bundle 11 is drawn through the fibrous bundle-introducing inlet 9 (hereinafter simply called the introducing inlet 9), pre-shaped in the tubular form while it passes in between the core pipe 7 and the fibrous bundle-introducing cylindrical pipe 6 (hereinafter simply called the introducing pipe 6) consisting of funnel-like portion and cylindrical portion, and is drawn through the nozzle 4 to the outside of the shaping apparatus 3. In order that the fibrous bundle 11 is uniformly pre-shaped in the shaping apparatus 3, it is preferably divided into plural, more preferably at least three portions, and is fed through a same plurality of introducing inlets 9 as said portions into the introducing pipe 6 where such portions are pre-shaped as an integrated piece. When the hot compressed gas is injected through the injecting hole 2, it heats the introducing pipe 6 from the outside, and tends to leave through the introducing pipe 6 and the fibrous bundle outlet 5 (hereinafter simple called the outlet 5) to the outside air. Then, since the cross-sectional area of the introducing pipe 6 is larger than that of the outlet 5 and the fibrous bundle 11 passes through the portion left by subtracting the cross-sectional area of the core pipe 7 from each cross-sectional area of the introducing pipe 6, the density of fibers in the introducing pipe 6 is lower than that in the outlet 5. In other words, the gaps between the fibers in the introducing pipe 6 is larger than that in the outlet 5. Hence, even if the introducing pipe 6 is increased in length, a larger amount of the injected hot gas escapes through the introducing pipe 6, rather than through the outlet 5, to the outside air. By further reason of the vents 8 provided along the surface of the core pipe 7, a portion of the injected hot gas passes through the fibrous layer, and is then sent out of the vents 8 to the outside through the interior of the core pipe 7 and teh opening 10, whereby the core pipe 7 per se is heated. Accordingly, while the fibrous bundle 11 moves from the introducing pipe 6 to the nozzle 4, it is pre-shaped in the tubular form and, at the same time, is heated from the outside and inside of it. Combined with the fact that the hot gas passes through the gaps between the fibers, such heating makes it possible for the fibrous bundle to be heated uniformly to its depth in an extremely short period of time, whereby the composite fibers are put into a hot-melt-adhesive state. If the core pipe 7 were neither hollow nor vented at 8, heating of the core pipe 7 would become insufficient so that insufficient adhesion takes place on the inner surface of the shaped body, with the cracking, surface roughening and the like occurring as a result.

In accordance with the present invention, while the fibrous bundle 11 passes through the introducing pipe 6, it is uniformly heated even to its depth in a relatively low density state; hence, where the fibrous bundle is thermally deformable, development of latent crimps and shrinkage occur uniformly. Thus, the form of the shaped body shaped by the subsequent nozzle 4 is stabilized without any deformation.

If the cross-sectional area between the introducing pipe 6 and the core pipe 7 is too large, too much release of the hot gas through the introducing inlet 9 then takes place so that difficulty is encountered in heating of the fibrous bundle 11. If that area is too small, then the fibers are press-bonded or nonuniformly adhered together. In an extreme case, it is impossible to draw the fibrous bundle 11 out of the nozzle 4. The cross-sectional area between the introducing pipe 6 and the core pipe 7 should preferably be 1.2 to 4 times as large as that between the nozzle 4 and the core pipe 7.

The length of the introducing pipe 6 should preferably be such that it extends with a length between the extremity of the introducing pipe 6 and the nozzle 4 corresponding to 1/10 to 3/10 of the overall length of the injecting chamber in order to directly heat the outer periphery of the fibrous bundle by the hot gas for a while and provides an inlet for the introducing pipe 6 and the core pipe 7.

In order to apply uniform heating to the fibrous bundle 11, the vents 8 to be formed in the core pipe 7 may be comprised of a number of small holes arranged in a zigzag and multi-stage manner, or a multi-stage arrangement of circumferential slits.

The shaped body leaving the nozzle 4 is cooled and solidified, taken up by the take-up means 13, and is cut to a desired length by the cutter 14. Cooling may be carried out in the conventional manners in which that body is passed through a pipe cooled as by air or water. Air cooling may usually be applied to the shaped body, while it leaves the nozzle 4 and reached the take-up means 13. For drawing, slight nipping may be applied to the shaped body with a grooved roll. The thus drawn body is cut into the product 15 by the cutter 14.

The present invention has the following effects.

(1) The obtained tubular shaped fibrous articles have the fibers sufficiently and uniformly adhered together on not only the outside face but also on the inside face, and thus excel in dimensional stability.

(2) The tubular shaped fibrous articles can bery easily be produced at a high speed, with the required apparatus being of a compact size.

(3) The obtained tubular shaped fibrous articles have the fibers sufficiently and uniformly hot-adhered together even to the depth with a controlled fiber bulk density selected from the considerably wide range of 1 to 40%.

(4) The obtained tubular shaped fibrous articles include fine and uniform voids formed by point-adhesion among the hot-melt-adhesive composite fibers, which voids are uniformly and finely distributed throughout the overall fibrous layer, and provide high-quality filters for gases or liquids.

EXAMPLE 1

Figure 2:
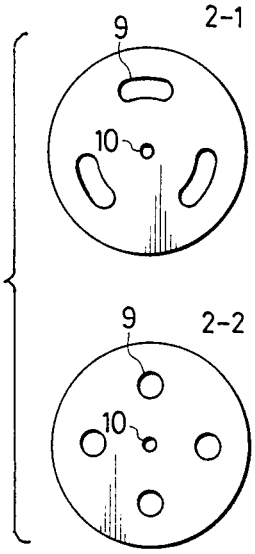
FIG. 2 is two sectional views taken along the line A—A of FIG. 1.
Figure 3:
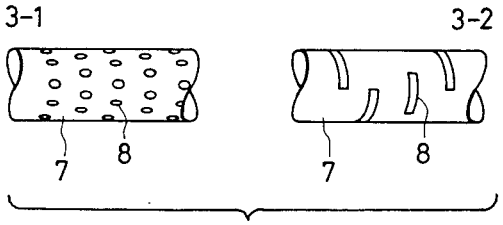
FIG. 3 is two enlarged views showing a part encircled at B in FIG. 1.
Figure 4:
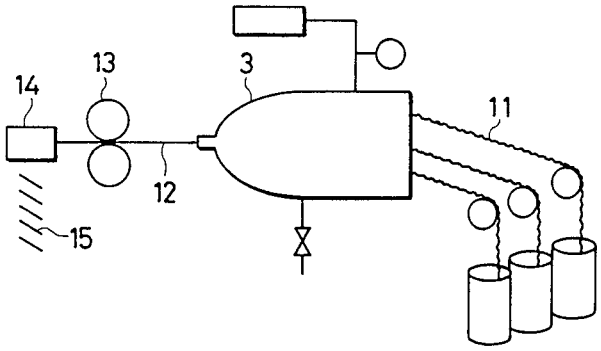
FIG. 4 is a general view showing one embodiment of the process according to the present invention.

To each introducing inlet 9 shown in FIG. 2(2-1) was fed a fibrous bundle 11 having a total fineness of 80,000 deniers, which consisted of highly crimpable hot-melt-adhesive composite fibers having a fineness of 3 D/F and composed of a low-melting component (with a M.P. of 110° C.) of an 1:3 blend of an ethylene-vinyl acetate copolymet (abbreviated as EVA, and having a vinyl acetate content of 20%) and polyethylene and a high-melting component (with a M.P of 165° C.) of polypropylene, said low-melting component having a circumferential proportion in cross-section of 80%. In this manner, a total fineness of 240,000 deniers of fibrous bundles were drawn to prepare a tubular shaped fibrous body 12. The shaping apparatus used includes a introducing pipe 6 having a total length of 28 cm and comprising a cylindrical portion of 12 mm in inner diameter and 13 cm in length and a funnel-like portion of 5 cm in length, a core pipe 7 of 3.6 mm in inner diameter, 6 mm in outer diameter and 26 cm in total length [having a total of 20 (five per one stage) of vents 8 in its portion extending from the introducing pipe 6], and a circular nozzle 4 of 10 mm in inner diameter and 20 mm in total length. While 2 Kg/cm$^2$ (gauge) of superheated steam were injected through the injecting hole 2, said fibrous bundles were passed at a rate of 30 cm/min for heating and shaping, thereby to obtain a tubular shaped fibrous body 12 of 10 mm in outer diameter and 6 mm in inner diameter. After air cooling, that body was cut into products 15 of 10 cm in length. The thus obtained shaped fibrous body 12 is found to be free from any fuzzing and cracking on the outer and inner faces thereof, and have a uniform thickness. To determine the resistance to water permeation of the wall of that body, it was attached to a housing for a cartridge filter. As a result, that body was found to have a resistance to water permeation of 0.11 Kg/cm$^2$ (gauge) at a water flow rate of 250 l/h, and be suitable for use as a water filter.

Comparison Example 1

A tubular shaped fibrous body was obtained in the same manner as in Example 1, provided that a core pipe having no vent was used. The obtained shaped body was found to be considerably fuzzed on the inner face, and was judged to be poor in adhesion. The resistance to water permeation was 0.04 Kg/cm$^2$ (gauge), and the shaped body was found to be crakced after measurement.

EXAMPLE 2

Thirty (30) % by weight of highly crimpable heat-adhesive composite fibers having a fineness of 3 D/F and a length of 102 mm and consisting of a sheath component of polyethylene (M. P.: 135° C.) and core component of polypropylene (M. P. : 165° C.) were blended with 70% by weight of highly crimpable acetate fibers having a fineness of 4 D/F and a length of 102 mm, and the resulting blended fibers were opened by carding into slivers, each of 7 g/m. The sliver was fed to each introducing inlet 9 shown in FIG. 2 (2-2) to draw a total of 28 g/m of fibrous bundles into a tubular shaped fibrous body 12 of 6 mm in inner diameter and 10 mm in outer diameter. The shaping apparatus used was the same as that of Example 1, except for the introducing inlet 9, and was operated at a shaping speed of 30 cm/min, while heating was carried out at 170° C. with 3 Kg/cm$^2$ (gauge) of superheated steam. A tubular shaped fibrous body 12 air-cooled and cut afterward to a length of 10 cm was found to be free from any fuzzing on both inner and outer faces, has a uniform thickness, and shows a resistance to water permeation of 0.10 Kg/cm$^2$ (gauge).

Comparison Example 2

A tubular shaped fibrous body was prepared in the same manner as in Example 2, provided that a core pipe having no vent was empolyed. The obtained body was found to be fuzzed even on the inner face, and uneven in thickness. This body was easily deformable between fingers, had a resistance to water permeation of barely 0.03 Kg/cm$^2$ (gauge), and was found to be unsuitable for use as a filter.

What is claimed is:

1. A process for producing tubular shaped fibrous articles by heating and cooling a fibrous bundle containing at least 20 weight % of hot-melt-adhesive composite fibers, wherein the improvements comprise:

(a) using a shaping apparatus including an injecting chamber, an injecting hole formed in the wall of said chamber, a fibrous bundle outlet provided with a nozzle of a desired shape in cross-section, a fibrous bundle-introducing cylindrical pipe, which has a cross-sectional area larger than that of said outlet and is located at a position opposite to said fibrous bundle outlet and projects toward said fibrous bundle outlet and terminates in said injecting chamber, and a core pipe which is opened at its base end on the outside of said injecting chamber and has its other end inserted through said fibrous bundle-introducing cylindrical pipe and extends into said nozzle through said injecting chamber and has vents along its surface in its portion exposed within said injecting chamber, and (b) passing said fibrous bundle through between said fibrous bundle-introducing cylindrical pipe and said core pipe to said fibrous bundle outlet, while injecting a hot compressed gas through said injecting hole, thereby to heat to and to shape said fibrous bundle at its hot-melt-adhesive temperature and to pass a portion of the hot gas through said fibrous bundle and into the core pipe through said vents.

2. A process as recited in claim 1, wherein, in said shaping apparatus, a cross-sectional area between said fibrous bundle-introducing cylindrical pipe and said core pipe is 1.2 to 4 times as large as that between said nozzle and said core pipe.

3. A process as recited in claim 1, wherein, as said hot-melt-adhesive fibers, use is made of composite fibers of a side-by-side or sheath-core structure, in which a difference in melting point between composite components is 20° C. or higher, and a low melting component has a circumferential proportion in cross-section of 50 to 100%.

4. A process as recited in claim 1, wherein, as said hot-melt-adhesive composite fibers, use is made of composite fibers selected from the combinations of composite components consisting of polypropylene/polyethylene, polypropylene/ethylene-vinyl acetate copolymet or their saponified products or mixture thereof, polyester/polypropylene and nylon 6/nylon 66.

5. A process as recited in claim 1, wherein said fibrous bundle is selected from tows, slivers and spun yarns.

* * * * *